US006374069B1

(12) United States Patent
Shin et al.

(10) Patent No.: US 6,374,069 B1
(45) **Date of Patent: *Apr. 16, 2002**

(54) PHOTOSENSITIVE BELT REMOVING DEVICE OF ELECTROPHOTOGRAPHIC PRINTING APPARATUS AND PHOTOSENSITIVE BELT REMOVING METHOD USING THE SAME

(75) Inventors: Hyun-seong Shin; Kwang-ho No, both of Suwon; Ho-dong Kim, Yongin, all of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/676,663

(22) Filed: Oct. 2, 2000

(30) Foreign Application Priority Data

Nov. 19, 1999 (KR) ..... 99-51495

(51) Int. Cl.[7] ..... G03G 15/00

(52) U.S. Cl. ..... 399/116; 399/162

(58) Field of Search ..... 399/26, 116, 161, 399/162, 165

(56) References Cited

U.S. PATENT DOCUMENTS 4,215,932 A * 8/1980 Castelli et al. ..... 399/161
6,195,517 B1 * 2/2001 Park et al. ..... 399/116

* cited by examiner

*Primary Examiner*—William J. Royer
(74) *Attorney, Agent, or Firm*—Sughrue Mion, PLLC

(57) ABSTRACT

A photosensitive belt removing device and a photosensitive belt removing method of an electrophotographic printing apparatus are disclosed. The photosensitive belt removing device includes: a belt cutting mechanism installed in the printing apparatus so as to cut in a widthwise direction the photosensitive belt installed at the belt unit in a continuous loop state; a filter cartridge installed in the vicinity of the belt unit for filtering objects floating in the air in the printing apparatus; an auxiliary housing provided at one side of the filter cartridge; a revolver rotatably installed in the auxiliary housing and provided with a through slot so that a leading edge of the photosensitive belt cut by the belt cutting mechanism can be inserted into the through slot; a leading edge introducing guide which guides the leading edge of the photosensitive belt cut by the belt cutting mechanism into the auxiliary housing and introduces the leading edge into the through slot of the revolver; and a driving source which rotates the revolver so that the revolver can wind up the photosensitive belt.

7 Claims, 8 Drawing Sheets

PHOTOSENSITIVE BELT REMOVING DEVICE OF ELECTROPHOTOGRAPHIC PRINTING APPARATUS AND PHOTOSENSITIVE BELT REMOVING METHOD USING THE SAME

BACKGROUND OF THE INVENTION

1. Field of the Invention

The present invention relates to a photosensitive belt removing device of an electrophotographic printing apparatus for removing a photosensitive belt from its installed position in order to replace the photosensitive belt installed in the electrophotographic printing apparatus, and a photosensitive belt removing method using the same.

2. Description of the Related Art

As shown in FIG. 1, an electrophotographic printing apparatus such as a color laser printer is provided with a photosensitive belt 10 which is supported by a plurality of rollers 11, 12 and 13 installed in a main body of the printing apparatus and circulates around a continuous loop. After an image to be printed is developed by predetermined developing units 15 on one surface of the photosensitive belt 10, and the developed image is dried while passing by a drying unit 16, the developed image is printed onto a paper 1 at a transfer unit 14 including a transfer roller 14*a* and a fuser roller 14*b*.

In this case, a unit in which the photosensitive belt 10 is supported by rollers in a continuous loop shape and circulates around the continuous loop is called a belt unit. In the developing unit 15, reference numeral 15*a* denotes a developing roller for forming an image on the photosensitive belt 10 with developer liquid supplied from a developer liquid supply portion (not shown), and reference numeral 15*b* denotes a development backup roller. In addition, reference numerals 15*c* and 15*d* denote a squeeze roller and a squeeze backup roller for pressing the photosensitive belt 10 and squeezing surplus developer from an image developed by the developing roller 15*a*.

However, when such a photosensitive belt 10 is used for a long time, the precision of an image deteriorates gradually. Therefore, when the photosensitive belt 10 reaches the end of its usable life, the photosensitive belt 10 must be replaced with a new one so that a clear image can be continuously developed. However, for such replacement, removal of a photosensitive belt 10 has been performed in a manner in which the used photosensitive belt 10 is taken out from its installed position in the belt unit directly by hand.

However, when, as described above, a user directly takes hold of and removes the photosensitive belt 10 after inserting his hand into a printer, the job in itself is bothersome and takes a long time, and, in addition, there is a danger in which the hand of the user may be injured due to interference with various structural frames when the photosensitive belt is taken out from the narrow inner space of the printer.

In addition, the printer is provided with a filter cartridge 17 therein for filtering internal air and exhausting the air. The filter cartridge 17 is arranged to filter foreign objects included in internal air while internal air passes through the filter cartridge 17 and is discharged to the outside by a discharge pump 18. Therefore, when the filter cartridge 17 is periodically replaced, and preferably replaced in accordance with the replacement period of the photosensitive belt 10, the filter cartridge 17 can maintain the required filtering capability.

However, in prior-art printers, since the filter cartridge 17 is handled separately from the photosensitive belt 10, it is troublesome to separately replace the filter cartridge 17 and the photosensitive belt 10 after they are separately removed.

SUMMARY OF THE INVENTION

To solve the above problems, it is an objective of the present invention to provide a photosensitive belt removing device of an electrophotographic printing apparatus which is adapted to perform the job of removing the photosensitive belt in a safe, convenient and fast manner, and a photosensitive belt removing method using the same.

Accordingly, to achieve the above objective, there is provided a photosensitive belt removing device of an electrophotographic printing apparatus for removing a photosensitive belt from its installed position in order to replace the photosensitive belt installed at a belt unit of the printing apparatus, the photosensitive belt removing device comprising: a belt cutting mechanism installed in the printing apparatus so as to cut in a widthwise direction the photosensitive belt installed at the belt unit in a continuous loop state; a filter cartridge installed in the vicinity of the belt unit for filtering objects floating in the air in the printing apparatus; an auxiliary housing provided at one side of the filter cartridge; a revolver rotatably installed in the auxiliary housing and provided with a through slot so that a leading edge of the photosensitive belt cut by the belt cutting mechanism can be inserted into the through slot; a leading edge introducing guide which guides the leading edge of the photosensitive belt cut by the belt cutting mechanism into the auxiliary housing and introduces the leading edge into the through slot of the revolver; and a driving source which rotates the revolver so that the revolver can wind up the photosensitive belt.

To achieve the above objective, there is provided a photosensitive belt removing method of an electrophotographic printing apparatus for removing a photosensitive belt from its installed position in order to replace the photosensitive belt installed at a belt unit of the printing apparatus, the printing apparatus including a photosensitive belt removing device, and the photosensitive belt removing device comprising a belt cutting mechanism installed in the printing apparatus so as to cut in a widthwise direction the photosensitive belt installed at the belt unit in a continuous loop state, a filter cartridge installed in the vicinity of the belt unit for filtering objects floating in the air in the printing apparatus, an auxiliary housing provided at one side of the filter cartridge, a revolver rotatably installed in the auxiliary housing and provided with a through slot so that a leading edge of the photosensitive belt cut by the belt cutting mechanism can be inserted into the through slot, a leading edge introducing guide which guides the leading edge of the photosensitive belt cut by the belt cutting mechanism into the auxiliary housing and introduces the leading edge into the through slot of the revolver, and a driving source which rotates the revolver so that the revolver can wind up the photosensitive belt, the photosensitive belt removing method including: cutting the photosensitive belt by operating the belt cutting mechanism; guiding the leading edge of the photosensitive belt cut by the belt cutting mechanism into the auxiliary housing and introducing the leading edge into the through slot of the revolver; winding the photosensitive belt into an auxiliary housing by rotating the revolver by the driving source; and taking the auxiliary housing into which the photosensitive belt is wound out of the printing apparatus together with the filter cartridge.

BRIEF DESCRIPTION OF THE DRAWINGS

The above objective and advantages of the present invention will become more apparent by describing in detail preferred embodiments thereof with reference to the attached drawings, in which.

DETAILED DESCRIPTION OF THE PREFERRED EMBODIMENTS

Figure 1:
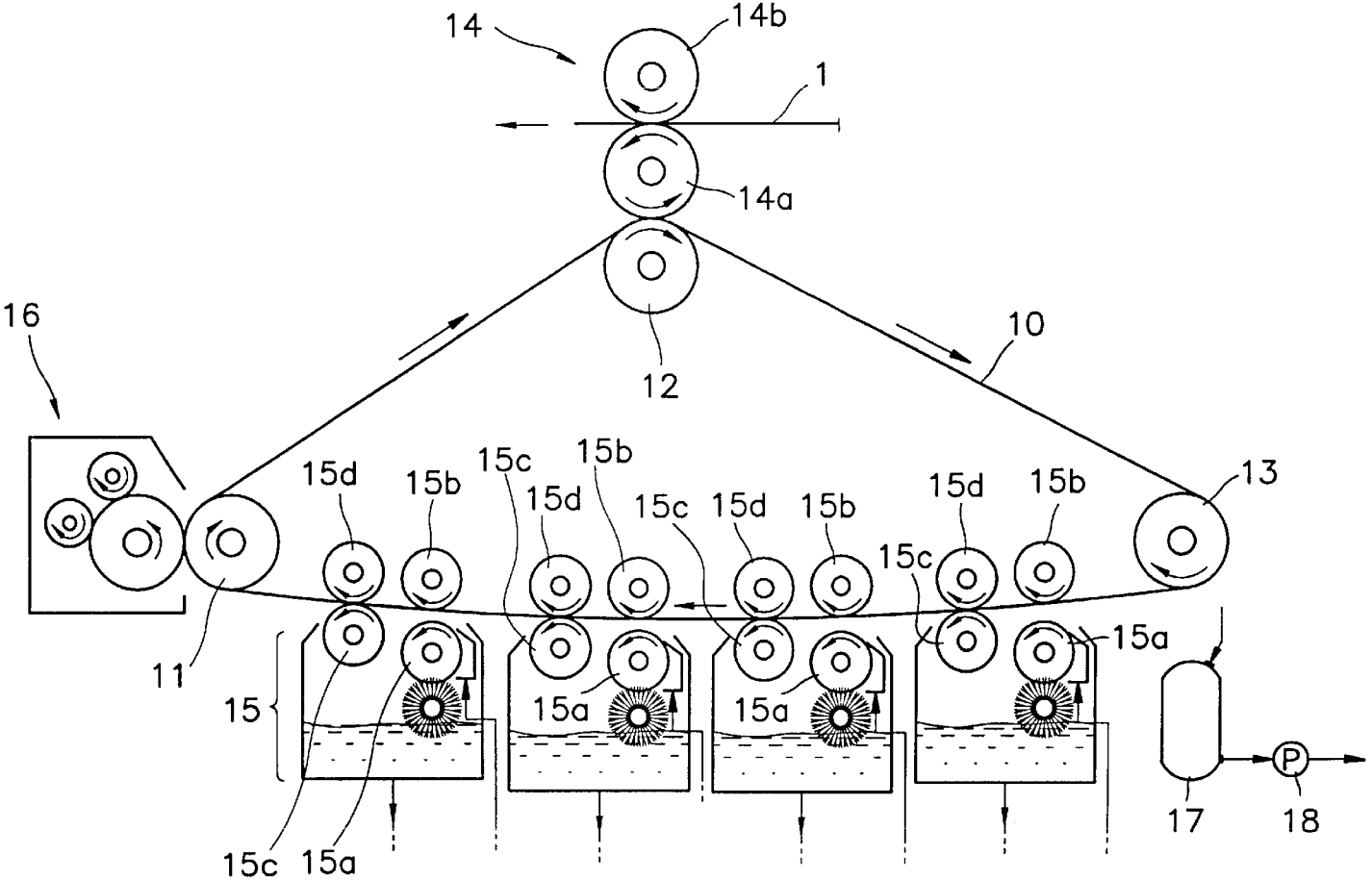
FIG. 1 (PRIOR ART)
FIG. 1 is a schematic diagram illustrating essential portions of a general electrophotographic printing apparatus.
Figure 2:
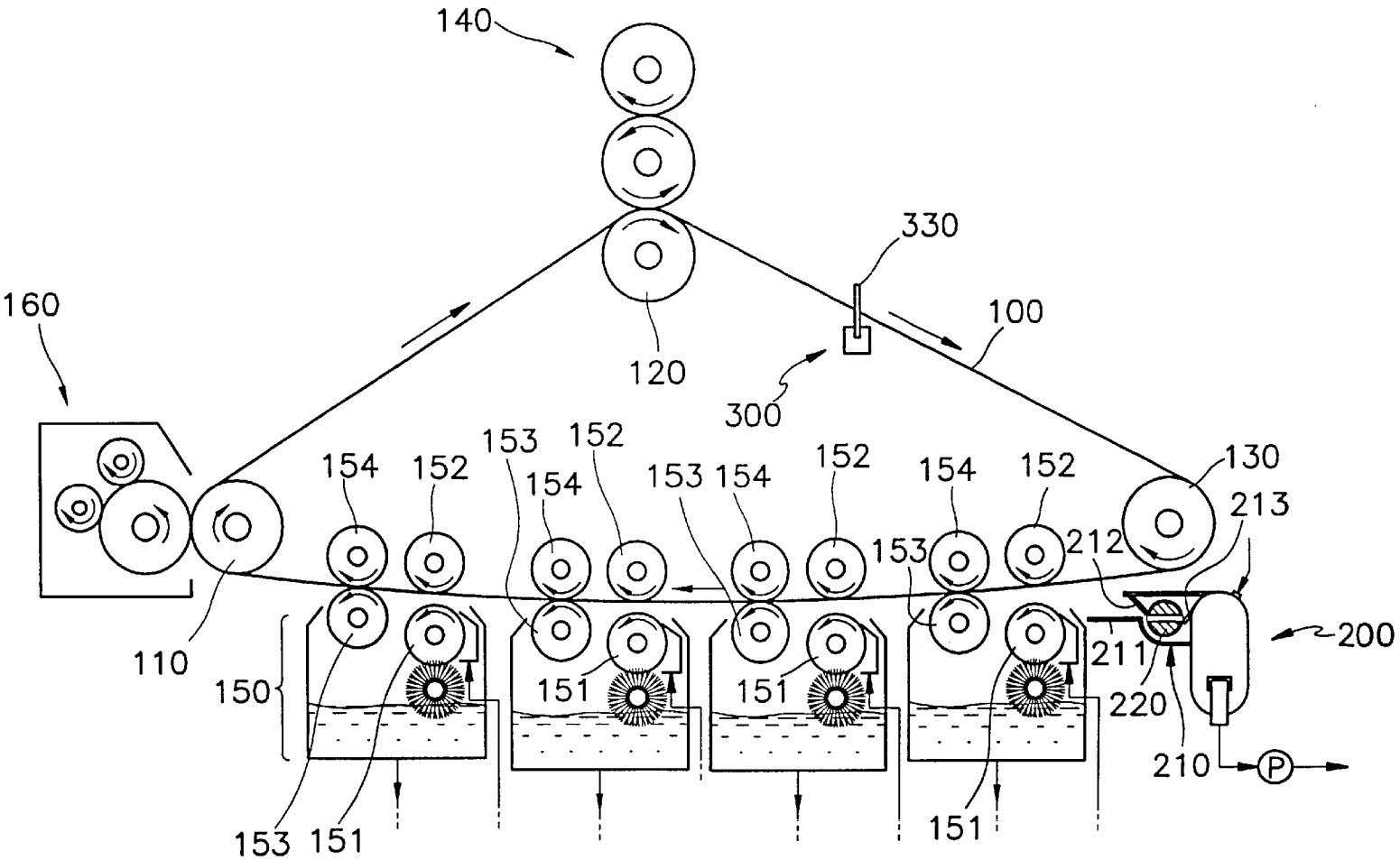
FIG. 2 is a schematic diagram illustrating the internal structure of an electrophotographic printing apparatus employing a photosensitive belt removing device according to the present invention.

First, FIG. 2 is a schematic diagram illustrating the internal structure of an electrophotographic printing apparatus employing a photosensitive belt removing device according to the present invention.

Referring to FIG. 2, a photosensitive belt 100 is supported around a plurality of rollers 110, 120, and 130 in a continuous loop shape, and developing units 150, a drying unit 160 and a transfer unit 140 are disposed along the path of the photosensitive belt 100. In addition, as described above, each developing unit 150 is provided with a developing roller 151 and a developing backup roller 152 for developing an image on the photosensitive belt 100, and a squeeze roller 153 and a squeeze backup roller 154 for squeezing out surplus developer liquid. Further, a filter cartridge 200 for purifying air discharged from the inside of the printing apparatus is installed in the vicinity of the photosensitive belt 100, and an auxiliary housing 210 is provided at a side of the filter cartridge 200. The squeeze roller 153 and the squeeze backup roller 154 additionally serve to transfer the photosensitive belt 100, cut by a belt cutting mechanism 300 which will be described below, into the auxiliary housing 210. In addition, the belt cutting mechanism 300 and a revolver 220 are provided at the upstream side of the developing units 150, and, in this case, the belt cutting mechanism 300 is for cutting the photosensitive belt 100 as described above when the photosensitive belt 100 is to be replaced, and the revolver 220 is rotatably supported within the auxiliary housing 210 for winding the cut photosensitive belt 100.

Figure 3:
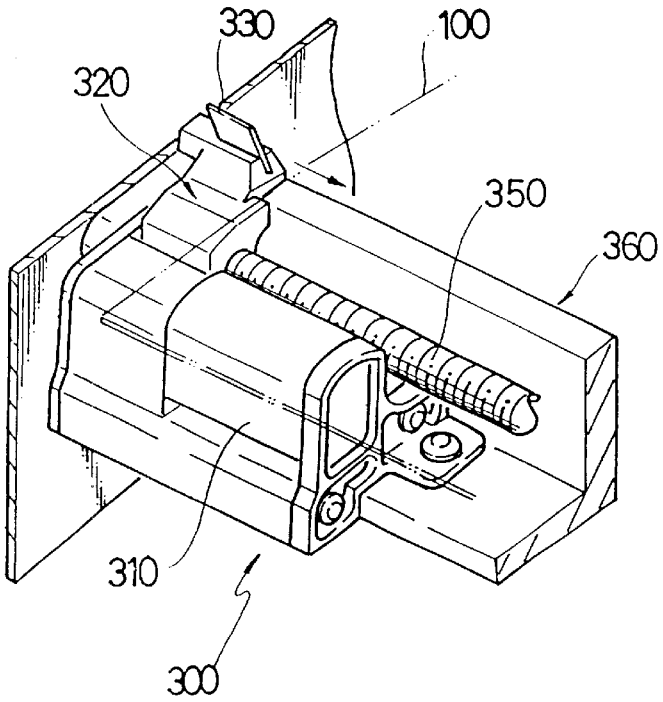
FIGS. 3 and 4 are perspective views illustrating a belt cutting mechanism of the photosensitive belt removing device shown in FIG. 2.
Figure 4:
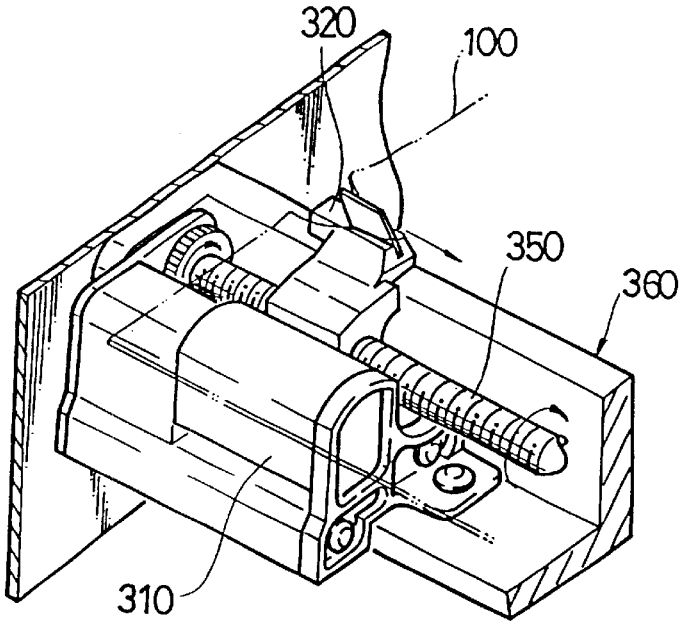

First, as shown in FIGS. 3 and 4, the belt cutting mechanism 300 includes a lead screw 350 which is rotated by a driving motor 310, a movable block 320 which is installed on the lead screw 350 so as to move back and forth according to the rotation of the lead screw 350, and a cutting blade 330 installed on the movable block 320. Reference numeral 360 denotes a sliding support portion, and the movable block 320 slides and moves back and forth while contacting the lower and side surfaces of the sliding support portion 360. Therefore, when the driving motor 310 operates and rotates the lead screw 350, the movable block 320 is moved across the photosensitive belt 100, and at this time the cutting blade 330 which is installed on the movable block 320 traverses the photosensitive belt 100 while cutting the photosensitive belt 100 as shown in FIG. 4.

Figure 5:
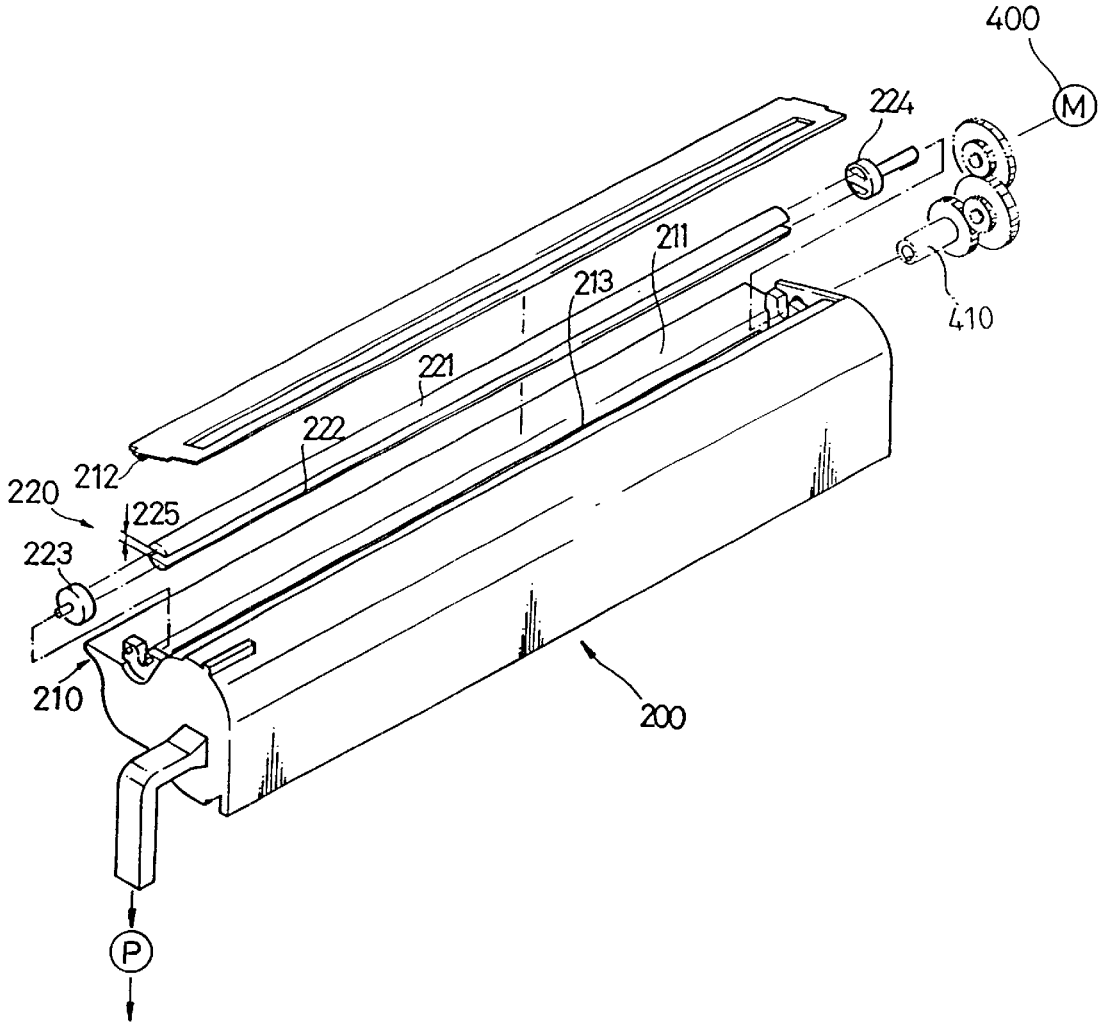
FIG. 5 is a perspective view illustrating an auxiliary housing portion for winding the photosensitive belt of the photosensitive belt removing device shown in FIG. 2.

Next, referring to FIGS. 2 and 5, the revolver 220 is rotatably installed in the auxiliary housing 210, and is comprised of two semicylindrical members 221l and 222 connected to support members 223 and 224 while spaced slightly apart from each other. Therefore, a through slot 225 is formed along the axis of the two semicylindrical members 221 and 222 between the spaced support members 223 and 224. Reference numeral 410 denotes a rotating shaft to which one end of the revolver 220 is connected, and reference numeral 400 denotes a driving motor for driving the rotating shaft 410. In addition, reference numerals 211 and 212 denote guide members of a leading edge introducing guide for guiding and introducing a leading edge of the photosensitive belt 100 cut by the cutting blade 330 into the auxiliary housing 210. Reference numeral 213 denotes an upward guide member which guides the leading edge of the photosensitive belt 100 so that it does not fall down, but moves in an upward direction after it has passed through the through slot 225 of the revolver 220. The upward guide member 213 also prevents the leading edge from being inserted into another gap formed in the auxiliary housing 210.

Figure 6:
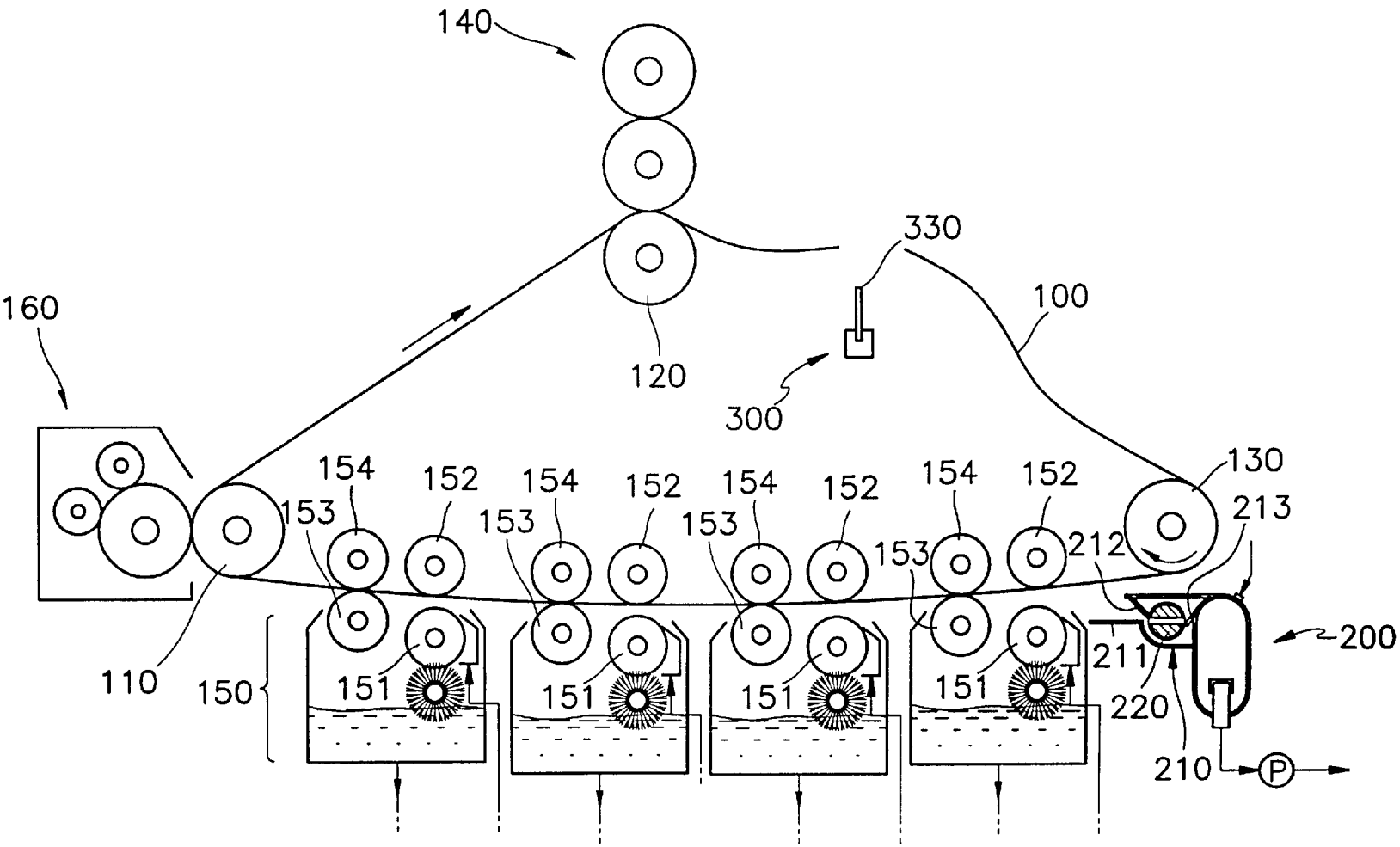
FIGS. 6 through 9 are diagrams illustrating a process of removing a photosensitive belt by the photosensitive belt removing device shown in FIG. 2.
Figure 7:
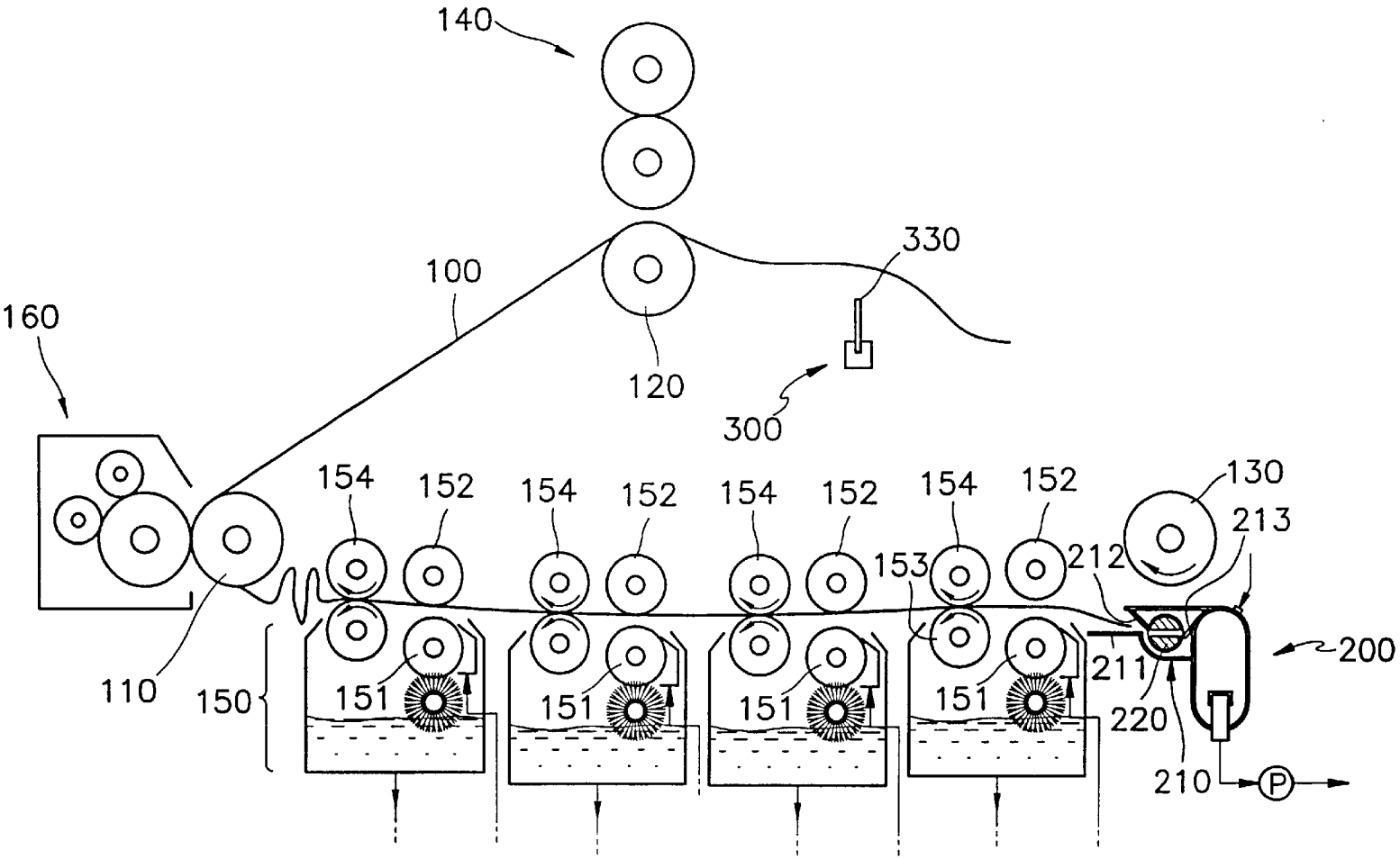
Figure 8:
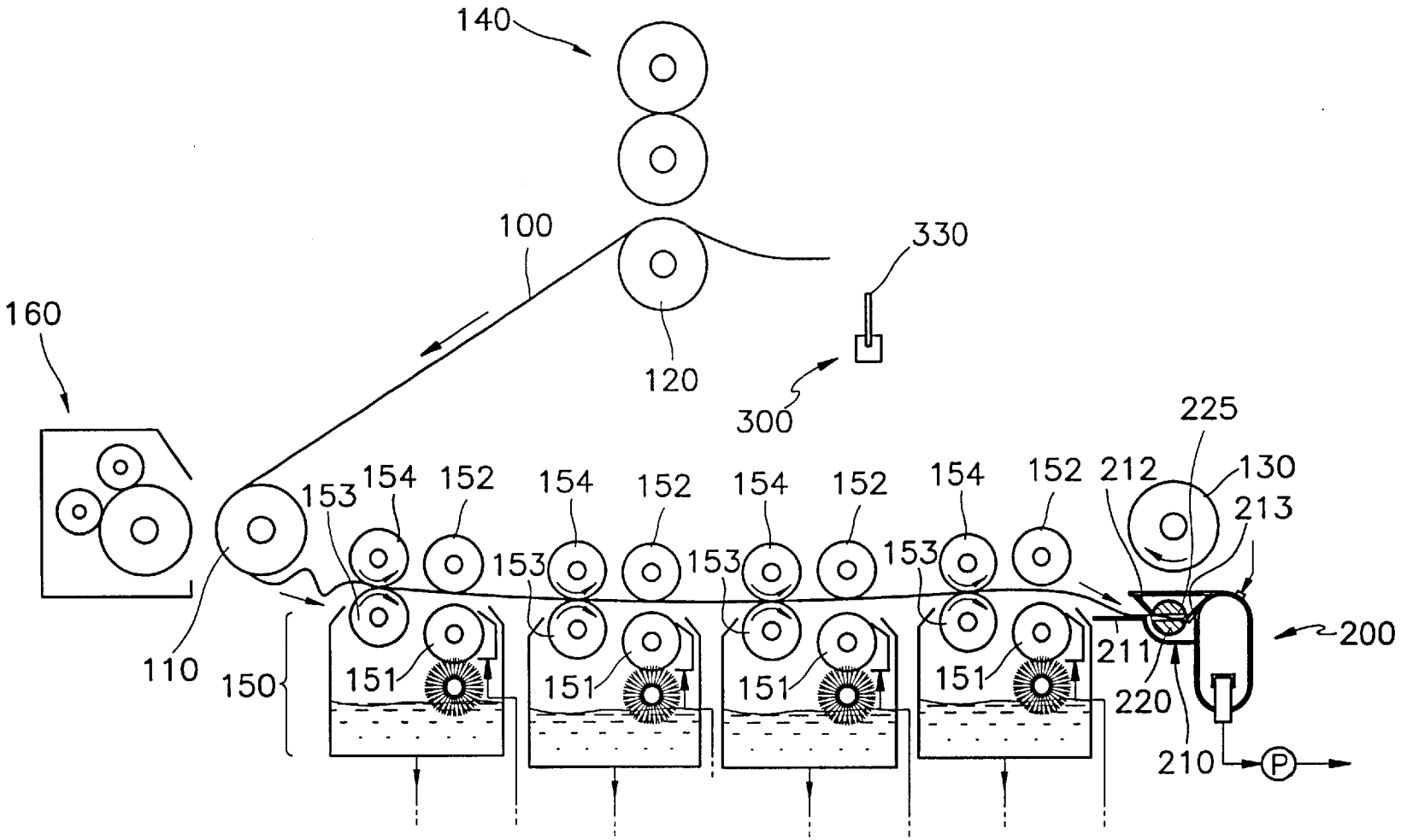
Figure 9:
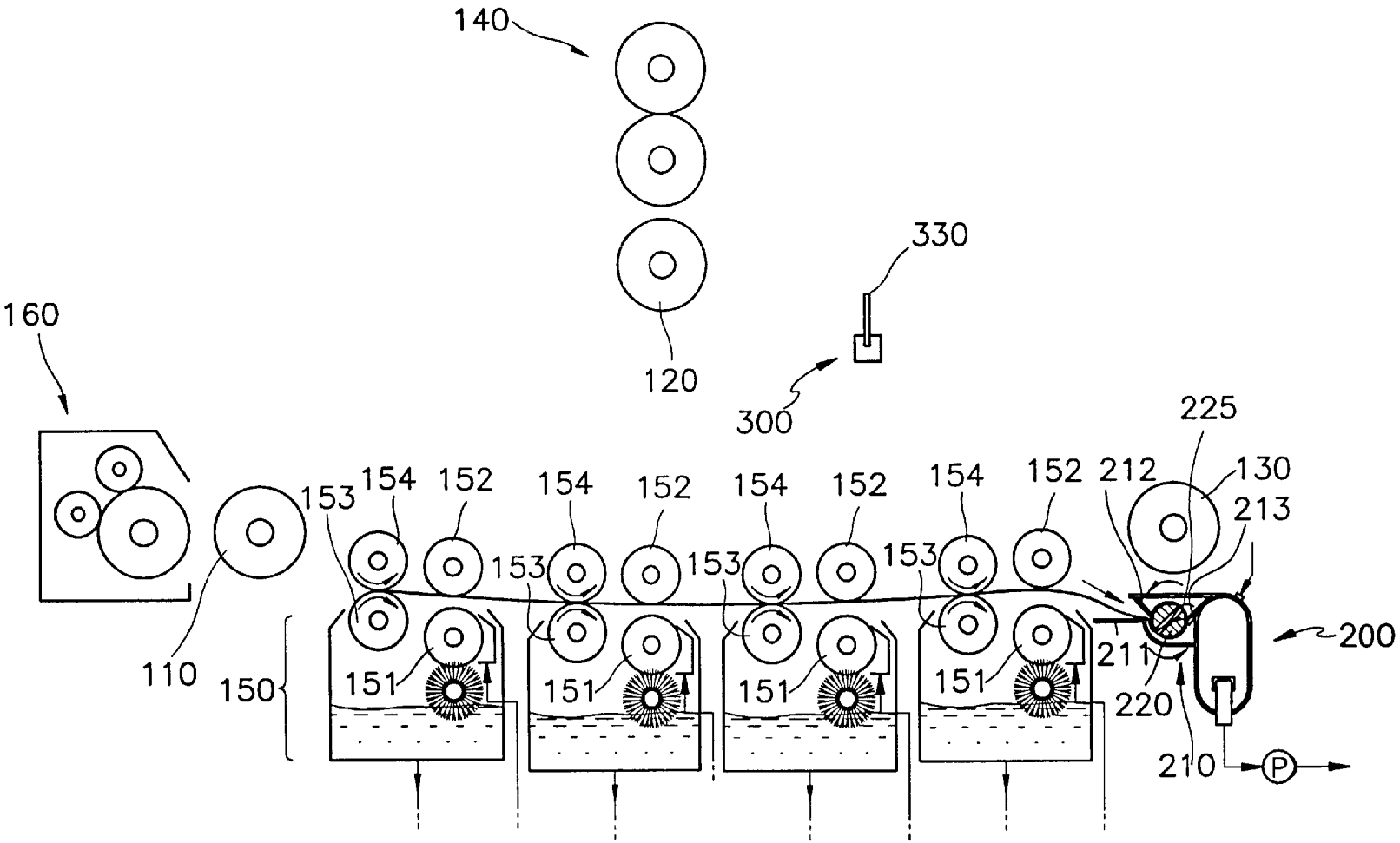

In the above structure, when the photosensitive belt 100 is to. be removed from its installed position in the belt unit, the belt cutting mechanism 300 is operated first so that the cutting blade 330 can cut the photosensitive belt 100 widthwise, as shown in FIG. 6. Then, as shown in FIG. 7, the squeeze roller 153 and the squeeze backup roller 154 are further rotated slightly in the rotation direction of the development operation so that the photosensitive belt 100 can be moved. At this time, the transfer unit 140 is separated from the photosensitive belt 100. However, since the drying unit 160 must hold the photosensitive belt 100 so that the photosensitive belt 100 does not fall down to another position, the drying unit 160 is still maintained in contact with the photosensitive belt 100. Thereafter, when the leading edge of the photosensitive belt 100 reaches the entry portion of the guide members 211 and 212, the squeeze roller 153 and the squeeze backup roller 154 are rotated in the direction opposite to that of the development operation, as shown in FIG. 8, so that the leading edge of the cut photosensitive belt 100 can be moved into the auxiliary housing 210 while being guided by the guide members 211 and 212. At this time, the transfer unit 140 and the drying unit 160 are spaced apart from the photosensitive belt 100 so that the load on the squeeze roller 153 and the squeeze backup roller 154 when pulling the photosensitive belt 100, and thereafter, the load on the revolver 220 when winding up the photosensitive belt 100 can be reduced. Then, after the leading edge of the photosensitive belt 100 has moved into the auxiliary housing 210 and subsequently passes through the through slot 225 of the revolver 220 installed therein, the leading edge moves slightly upward on the upward guide member 213 (see FIG. 9). When the driving motor 400 is rotated after the leading edge moves into the through slot 225 as above, the revolver 220 winds the photosensitive belt 100 around the outer circumferential surface of the revolver 220 within the auxiliary housing 210 while the revolver 220 rotates. Then, when the photosensitive belt 100 is completely wound up in the auxiliary housing 210, the filter cartridge 200 is taken out of the printer, and then a new filter cartridge 200 is inserted into its installation position in the printer.

In addition, the operation of guiding and winding the photosensitive belt 100 in the auxiliary housing 210 as described above can be fully controlled by counting rotations of the motor 400 without installing a separate sensor for sensing the leading edge of the photosensitive belt 100.

Therefore, when the photosensitive belt 100 must be removed from the belt unit for replacement, the photosensitive belt 100 is cut, is wound into the auxiliary housing 200, and then is removed together with the filter cartridge 200 from the printer.

As described above, when a photosensitive belt is removed by using the photosensitive belt removing device of an electrophotographic printing apparatus and the method using the same according to the present invention, a replacement job can be performed in a very convenient and fast manner, since the photosensitive belt is removed after being automatically wound into an auxiliary housing provided at a filter cartridge. Further, since the photosensitive belt is removed together with the filter cartridge, there is an advantage in that consumable parts can easily be managed, since the photosensitive belt and the filter cartridge can be managed as a unit instead of separately managing them according to their replacement periods.

It is contemplated that numerous modifications may be made to the photosensitive belt removing device and method of the present invention without departing from the spirit and scope of the invention as defined in the following claims.

What is claimed is:

1. A photosensitive belt removing device of an electrophotographic printing apparatus for removing a photosensitive belt from an installed position in order to replace the photosensitive belt installed at a belt unit of the printing apparatus, the photosensitive belt removing device comprising:

a belt cutting mechanism installed in the printing apparatus so as to cut in a widthwise direction the photosensitive belt installed at the belt unit in a continuous loop state;

a filter cartridge installed in a vicinity of the belt unit for filtering objects floating in the air in the printing apparatus;

an auxiliary housing provided at one side of the filter cartridge;

a revolver rotatably installed in the auxiliary housing and provided with a through slot so that a leading edge of the photosensitive belt cut by the belt cutting mechanism is operative to be inserted into the through slot;

a leading edge introducing guide which guides the leading edge of the photosensitive belt cut by the belt cutting mechanism into the auxiliary housing and introduces the leading edge into the through slot of the revolver; and a driving source which rotates the revolver so that the revolver is operative to wind up the photosensitive belt.

2. The photosensitive belt removing device as claimed in claim 1, wherein the belt cutting mechanism includes:

a driving unit provided at the printing apparatus; and a cutting blade driven by the driving unit and cutting the photosensitive belt while traversing across the photosensitive belt widthwise.

3. The photosensitive belt removing device as claimed in claim 2, wherein the driving unit includes:

a driving motor;

a lead screw disposed parallel to a width vector of the photosensitive belt and rotated by the driving motor; and a movable block on which the cutting blade is installed and which is mechanically connected to the lead screw so as to move across the photosensitive belt parallel to the width vector of the photosensitive belt according to the rotation of the lead screw.

4. The photosensitive belt removing device as claimed in claim 1, wherein the leading edge introducing guide includes:

a pair of rollers installed to rotate while pressing and supporting the photosensitive belt, and for transferring the leading edge of the photosensitive belt cut by the belt cutting mechanism toward the auxiliary housing; and guide members installed at the entryway of the auxiliary housing for guiding the leading edge of the photosensitive belt transferred by the pair of rollers so that the leading edge can be introduced into the through slot of the revolver.

5. The photosensitive belt removing device as claimed in claim 4, wherein the leading edge introducing guide further includes an upward guide member installed in the auxiliary housing for guiding the leading edge of the photosensitive belt so that the leading edge is operative to move in an upward direction after having passed through the through slot.

6. The photosensitive belt removing device as claimed in claim 1, wherein the driving source includes:

a rotatable shaft connected to the revolver; and a driving motor for rotating the rotatable shaft.

7. A photosensitive belt removing method of an electrophotographic printing apparatus for removing a photosensitive belt from an installed position in order to replace the photosensitive belt installed at a belt unit of the printing apparatus, the printing apparatus including a photosensitive belt removing device, and the photosensitive belt removing device comprising a belt cutting mechanism installed in the printing apparatus so as to cut in a widthwise direction the photosensitive belt installed at the belt unit in a continuous loop state, a filter cartridge installed in a vicinity of the belt unit for filtering objects floating in the air in the printing apparatus, an auxiliary housing provided at one side of the filter cartridge, a revolver rotatably installed in the auxiliary housing and provided with a through slot so that a leading edge of the photosensitive belt cut by the belt cutting mechanism is operative to be inserted into the through slot, a leading edge introducing guide which guides the leading edge of the photosensitive belt cut by the belt cutting mechanism into the auxiliary housing and introduces the leading edge into the through slot of the revolver, and a driving source which rotates the revolver so that the revolver can wind up the photosensitive belt, the photosensitive belt removing method including:

cutting the photosensitive belt by operating the belt cutting mechanism;

guiding the leading edge of the photosensitive belt cut by the belt cutting mechanism into the auxiliary housing and introducing the leading edge into the through slot of the revolver;

winding the photosensitive belt into an auxiliary housing by rotating the revolver by the driving source; and taking the auxiliary housing into which the photosensitive belt is wound out of the printing apparatus together with the filter cartridge.

* * * * *